United States Patent [19]

Hoyme

[11] 4,426,993

[45] Jan. 24, 1984

[54] VALVE FOR APPLIANCE COMBUSTION AIR INLET

[76] Inventor: Clifford L. Hoyme, P.O. Box 1485, Camrose, Alberta, Canada, T4V 1X3

[21] Appl. No.: 225,729

[22] Filed: Jan. 15, 1981

[51] Int. Cl.[3] ..... F24C 3/00

[52] U.S. Cl. ..... 126/85 B; 236/1 G; 431/20

[58] Field of Search ..... 236/1 G; 431/20; 126/85 B, 285 R

[56] References Cited

U.S. PATENT DOCUMENTS

| | | | |
|---|---|---|---|
| 2,768,675 | 10/1956 | Conn | 236/1 G |
| 2,937,697 | 5/1960 | Johnson | 236/1 G |
| 3,092,320 | 6/1963 | Powers | 236/1 G |

*Primary Examiner*—Ronald C. Capossela
*Attorney, Agent, or Firm*—Harvey B. Jacobson

[57] ABSTRACT

An interior building area containing at least one combustion type heating appliance is equipped with a combustion air inlet having an openable and closable damper operatively associated therewith. The damper is weighted for gravity closing and is suspended from a swinging pivot in a manner to assure a substantially airtight closure for the combustion air inlet. In addition, actuator structure is provided for each combustion-type heating appliance within the interior building area and operatively associated with the damper for moving the latter to an open position responsive to operation of at least one of the heating appliances.

8 Claims, 7 Drawing Figures

VALVE FOR APPLIANCE COMBUSTION AIR INLET

BACKGROUND OF THE INVENTION

When one or more combustion-type heating appliances are housed within an interior building area, that interior area must be provided with a combustion air inlet in order to supply the area with sufficient exterior air to support the desired combustion. However, the admission of exterior air to such an interior building area admits cold air during cold weather and hot air during the summer, even during periods of non-usage of the combustion-type heating appliances for which the inlet is designed to provide a supply of combustion air. Accordingly, in the interest of saving energy, several different forms of damper actuating mechanisms heretofore have been provided for automatically closing such a combustion air inlet during periods of non-usage of the associated combustion-type heating appliances.

However, many of these actuating mechanisms rely upon fixed pivot swinging of the associated dampers and solenoid actuators whose stroke may not be perfectly matched to the desired opening and closing of the associated damper with the result that the damper may not fully open or may not fully close in a reliable manner. Examples of previously known forms of damper actuating mechanisms and other similar devices including some of the general structural and operational features of the instant invention are disclosed in U.S. Pat Nos. 2,224,705, 2,357,642, 3,773,028, 4,055,699, 4,108,369 and 4,143,811.

BRIEF DESCRIPTION OF THE INVENTION

The damper valve assembly of the instant invention is mounted for angular displacement between open and closed positions relative to a combustion air inlet duct, but the axis of oscillation of the damper is not fixed. Instead, the axis is swingable and the solenoid includes sufficient stroke whereby the damper will have its axis of oscillation slightly shifted through an arcuate path relative to the combustion air inlet each time the damper is opened and closed. In this manner, the mating surfaces of the combustion inlet duct and damper are maintained free of obstructions and full opening and closing of the damper is assured.

The main object of this invention is to provide a combustion-type heating appliance combustion air inlet damper assembly which will be operative to substantially fully close the combustion air inlet duct during periods of non-operation of an associated combustion-type heating appliance.

Another object of this invention is to provide a damper control which may be readily operatively associated with the controls of various types of combustion-type heating appliances.

Still another object of this invention is to provide a damper control constructed in a manner whereby the mating surfaces of the damper and associated combustion air inlet will be self-cleaning.

Another very important object of this invention is to provide a damper for a combustion air inlet constructed in a manner whereby the damper may have more than one control operatively associated therewith in a manner such that the damper will be under the operation of several controls, each of which being operated by a corresponding combustion-type heater.

A final object of this invention to be specifically enumerated herein is to provide a combustion air inlet damper and control therefor which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
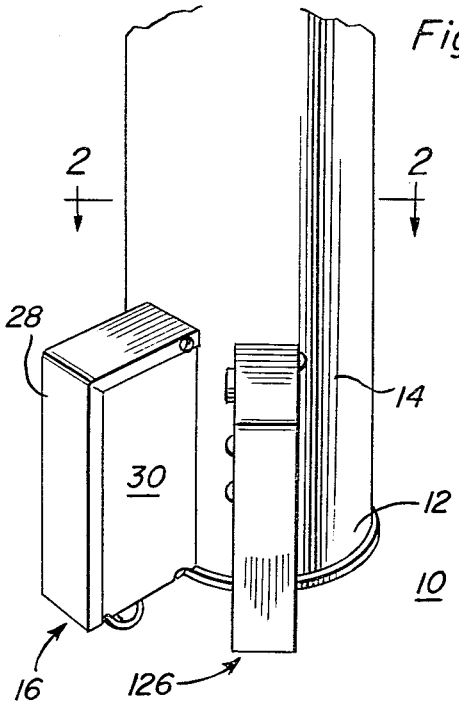
FIG. 1 is a fragmentary perspective view of a conventional form of downwardly opening combustion air inlet having the damper valve of the instant invention operatively associated therewith and with the damper valve incorporating two actuator mechanism therefor.

Referring now more specifically to the drawings, the numeral 10 designates an interior building area into which the downwardly opening outlet end 12 of a combustion air inlet 14 opens. The area 10 has two combustion-type heating appliances (not shown) disposed therein and the combustion air inlet 14 is provided to supply the required combustion air for the area 10 during operation of the combustion-type heating appliance therein.

The inlet 14 comprises a cylindrical duct and the end edges thereof are disposed in a generally horizontal plane.

The damper assembly of the instant invention is referred to in general by the reference numeral 16 and includes a mount 18 secured to one side 20 of the combustion air inlet duct 14 through the utilization of spacer-type grommets 22 and fasteners 24. The mount 18 includes a portion 26 struck therefrom and bent into generally semi-circular configuration for purposes to be hereinafter fully set forth. In addition, the mount 18 includes a removable cover 28 for substantially enclosing the area disposed between opposite side wall portions 30 of the mount.

The damper assembly 16 includes a circular damper plate 34 of slightly greater diameter than the diameter of the lower end 12 of the duct 14. An elongated lever plate 36 is longitudinally slotted at one end and secured to one marginal edge portion of the damper plate 34 through the utilization of fasteners 38 secured through the damper plate and the slots formed in the lever plate 36. In this manner, the damper plate 34 may be slightly shifted longitudinally of the lever plate 36 and secured in adjusted position.

The portion 26 defines a seat in which a plastic cylindrical bearing 40 is seated and the cylindrical bearing 40 rotatably receives the upper horizontal arm portion 42 of a horizontally opening U-shaped link 44 including a lower horizontal arm portion 46 and a vertical member 48 extending between and interconnecting the arm portions 42 and 46. The arm portion 42 is disposed at substantially 87° relative to the vertical member 48 and the arm portion 46 is disposed at substantially 93° relative to the vertical member 48. Further, a plastic wear sleeve 50 is disposed on the vertical member 48 and a shouldered plastic sleeve bearing 52 is disposed on the lower arm portion 46.

The lever plate 36 includes a laterally struck portion 54 defining a journal in which the sleeve bearing 52 is received and a semi-cylindrical portion 56 defining an upwardly opening semi-cylindrical seat. The portions 54 and 56 are spaced longitudinally of the lever plate 36 and the end of the lever plate 36 remote from the damper plate 34 includes a cylindrical end portion 58 in which a cylindrical weight 60 is secured.

The lever plate 36 includes a central aperture 62 intermediate the portions 54 and 56 and an elongated spring arm 64 is provided and includes a first journal end 66, an upwardly opening slotted seat defining portion 68 intermediate its opposite ends and a second downwardly opening seat defining end 70 including a pair of opposite side tangs 72 downwardly receivable through apertures 74 formed in the lever plate 36.

A T-pin 76 includes a split plastic sleeve 78 on its upper end seated in the seat defining portion 68 and the depending shank of the T-pin 76 projects downwardly through the aperture 62 and has a retaining washer 80 removably secured thereon, a compression spring 82 being disposed about the depending shank of the T-pin 76 between the retaining washer 80 and the underside of the apertured portion of the lever plate 36.

A solenoid 84 is supported from the mount 18 in any convenient manner and includes a vertically shiftable armature 86 which is spring urged downwardly and a miniswitch 88 is supported from the solenoid 84 and includes a pivoted actuating arm 90 engageable by a plastic wear sleeve 92 carried by the extended free end of the upper horizontal arm portion 94 of a second U-shaped link 96 including a lower horizontal arm portion 98 having a shouldered plastic wear sleeve 100 thereon and including a vertical member 102 extending between and interconnecting corresponding ends of the upper and lower arm portions 94 and 98, the vertical member 102 having a wear sleeve 104 mounted thereon and the journal end 66 receiving the sleeve 100 therethrough and being seated in the seat portion 56.

The lower end of the armature 86 is bifurcated and the arm portion 94 is received through registered bores formed in the furcations 106 of the armature 86 and that portion of the arm portion 94 disposed between the furcations 106 has a rubber bumper disc 108 journaled thereon.

Figure 7:
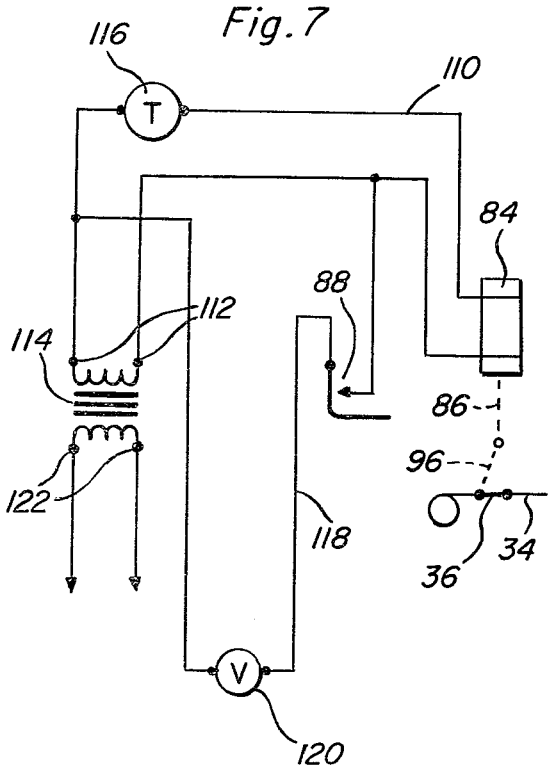
FIG. 7 is a diagrammatic view illustrating the manner in which the primary actuating mechanism may be electrically connected in the control circuit for a combustion-type heating appliance.

With attention now invited more specifically to FIG. 7 of the drawings, it may be seen that the solenoid 84 is serially connected in a loop circuit 110 electrically connecting the secondary terminals 112 of a transformer 114 and that a thermostat 116 is also serially connected in the loop circuit 110. Further, a second loop circuit 118 is connected in parallel to the circuit 110 and bypasses the thermostat 116 and the solenoid 84. The normally open switch 88 and the fuel valve 120 for the associated heating appliance are serially connected in the loop circuit 118. Of course, it is to be noted that the transformer 114 includes primary circuit terminals 122 for electrical connection to any suitable source (not shown) of electrical potential.

Figure 3:
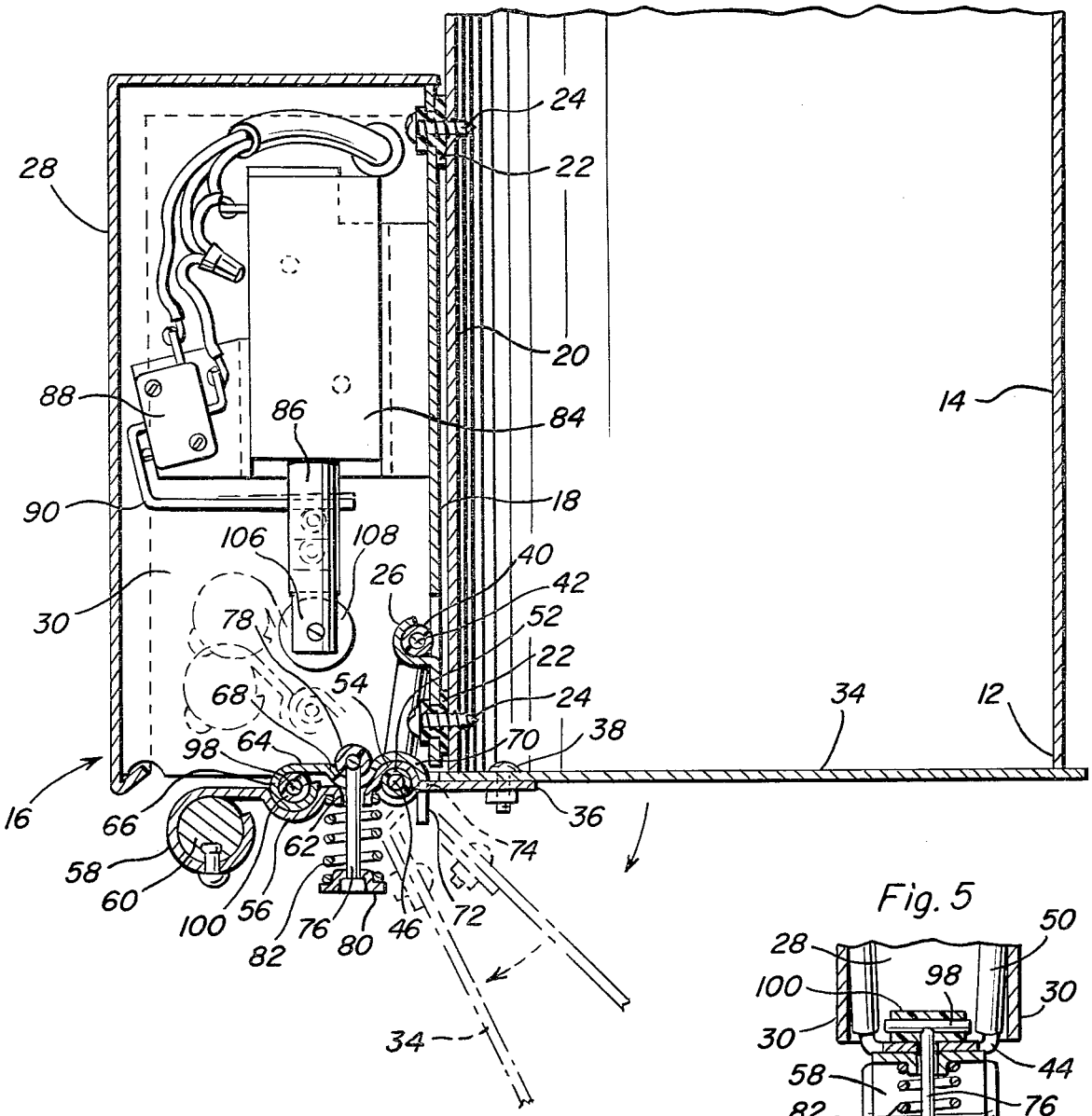
FIG. 3 is an enlarged fragmentary vertical sectional view taken substantially upon the plane indicated by the section line 3—3 of FIG. 2 and illustrating the primary actuating mechanism for the damper.
Figure 5:
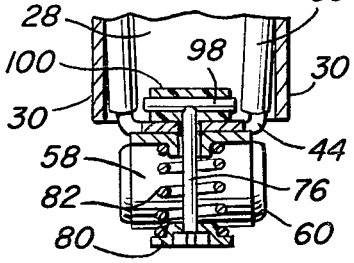
FIG. 5 is a fragmentary vertical sectional view taken substantially upon the plane indicated by the section line 5—5 of FIG. 4.
Figure 4:
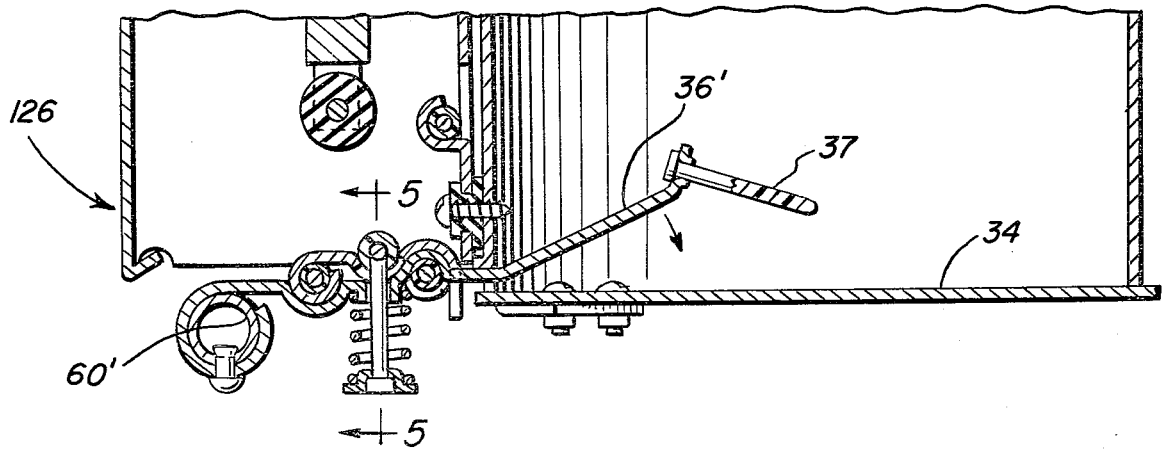
FIG. 4 is an enlarged fragmentary vertical sectional view taken substantially upon the plane indicated by the section line 4—4 of FIG. 2 and illustrating a secondary damper valve actuating mechanism.

In operation, when the thermostat 116 senses a need for heat, the switch therein is closed and the circuit 110 is actuated to operate the solenoid 84 whereupon the armature 86 is raised and the damper plate 34 is pivoted to the open position thereof illustrated in phantom lines in FIG. 3. Upon upward movement of the armature 86, the wear sleeve 92 of the U-shaped link 96 engages and upwardly deflects the switch arm 90 in order to close the switch 88 and to thereby also electrically actuate the fuel valve 120 for the associated heating appliance. However, as soon as the thermostat 116 is "satisfied", the circuit 110 is opened and the solenoid 84 is deactivated whereby the armature 86 will drop to the position thereof illustrated in FIG. 3 of the drawings and return the damper plate 34 to the closed position thereof illustrated in solid lines in FIG. 3. Also, upon lowering of the armature 86, the wear sleeve 92 will be lowered and thus allow the switch 88 to open and in turn cause the fuel valve 120 to be closed.

When the armature 86 is raised, the stroke of the armature 86 is greater than that required to swing the damper plate 34 to the open position. Accordingly, the swing arm 64 has its left end (as viewed in FIG. 3) swung upwardly relative to the underlying portion of the lever plate 36 against the biasing action of the spring 82 and, accordingly, the pivot (lower arm portion 46) for the damper plate 34 is free to swing about the upper pivot (arm portion 42) of the link 44. Of course, the T-pin 76 and the spring 82 as well as the tangs 72 maintain the proper positioning of the swing arm 64 relative to the lever plate 36 thereby insuring a proper closing of the damper plate 34.

Figure 2:
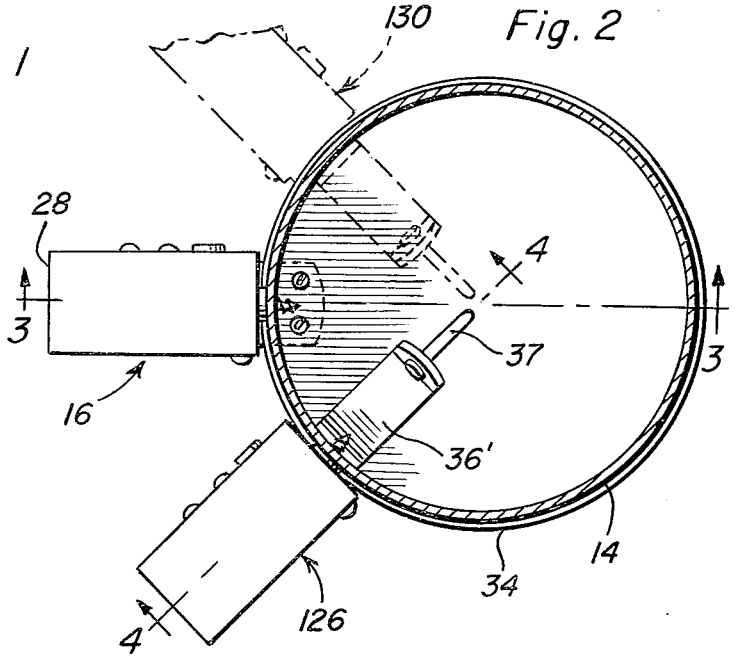
FIG. 2 is an enlarged horizontal sectional view taken substantially upon the plane indicated by the section line 2—2 of FIG. 1.
Figure 6:
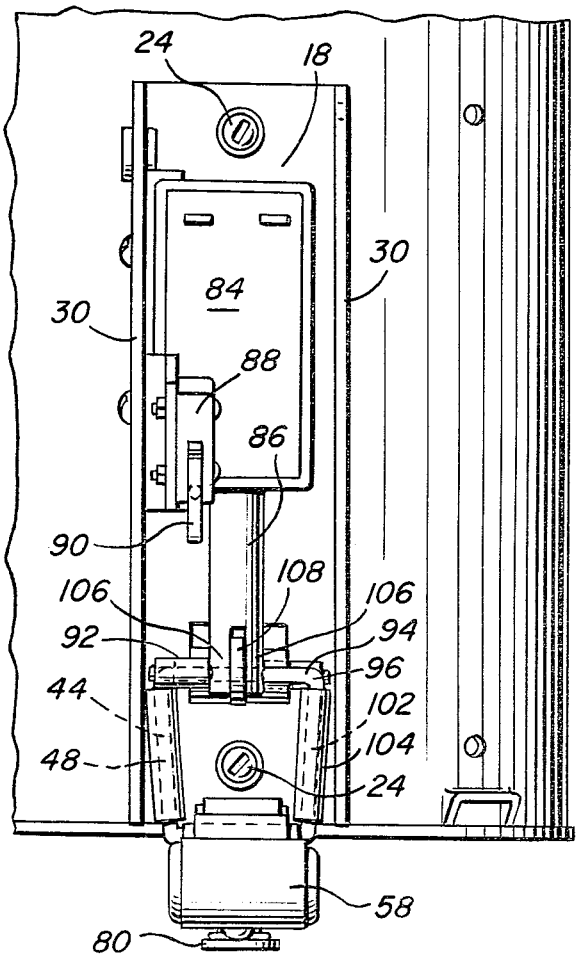
FIG. 6 is a fragmentary enlarged side elevational view of the assemblage illustrated in FIG. 2 and with the cover for the primary actuating mechanism removed and the complete secondary actuating mechanism removed.

If the interior building area 10 has a second (or third) heating appliance therein, a secondary damper actuating assembly referred to in general by the reference numeral 126 may be used in conjunction therewith. The secondary damper actuating assembly is substantially identical to the damper actuating previously described, except that the lever plate 36' thereof is not connected directly to the damper plate 34, but is instead upwardly directed and provided with a plastic abutment pin 37 for engagement with a slightly off-center position of the damper plate 34. In addition, the weight 60' of the damper assembly 126 corresponding to the weight assembly 60 need not be as heavy and is thus hollow. However, if the second heating appliance is actuated under the control of its own thermostat (not shown) when primary heating appliance under the control of the damper assembly 16 is not in operation, the damper assembly 126 will be operative to move the damper plate 34 toward its open position in a manner which is believed to be obvious but short a position thereof effective to raise the plastic wear sleeve 92 sufficiently to contact the actuating arm 90. Still further, if the interior building area 10 includes a third heating appliance, a third damper actuating assembly 130 may be provided, see FIG. 2, similar to damper assembly 126.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination, an interior building area in which at least one heat of combustion powered appliance is disposed, a combustion air inlet for said building area including an air supply duct having an outlet end opening into said area, a valve assembly for said outlet end for closing said outlet end during periods of non-operation of said appliance and opening said outlet and during periods of operation of said appliance, said valve assembly including a mount supported adjacent one side of said outlet end and defining a pivot axis disposed transverse to a path extending generally radially outwardly from the center of said outlet end, a damper plate mounted for swinging oscillation about said axis between a closed position extending across and closing said outlet end and an open position inclined relative to and extending outwardly of said outlet end, and a thermostat electrical circuit controllable solenoid operatively connected with said damper plate for applying opening and closing forces upon said damper plate to open and close said damper plate responsive to electrical actuation and deactuation, respectively of said solenoid, said damper plate including means gravity yieldingly biasing said damper plate toward the closed position thereof, said solenoid being connected to said damper plate by connecting means establishing a lost motion connection therewith wherein full movement of the damper plate to the open position thereof may lag relative to full actuation of said solenoid to open said damper plate, said connecting means including means yieldingly biasing said damper plate toward said open position responsive to full actuation of said solenoid, said connecting means establishing a positive connection between said solenoid and damper plate to positively close the latter responsive to deactuation of said solenoid.

2. The combination of claim 1 wherein said mount includes support means supporting said pivot axis for lateral shifting away and toward said one side of said outlet end.

3. The combination of claim 2 wherein said support means includes means operative gravity biasing said pivot axis toward said one side of said outlet axis.

4. The combination of claim 1 wherein said area encloses at least one additional heat of combustion powered appliance under the control of a corresponding thermostat electrical circuit, a lever pivotally supported from a second side of said outlet end and including a first end inwardly of said outlet end and having a terminus for engagement with the central area of said plate in sliding abutting engagement therewith, a second solenoid under the control of said corresponding thermostat electrical circuit, means operatively connecting said second solenoid with said lever for pivotal movement of the latter between active and inactive positions responsive to actuation and deactuation of said second thermostat, respectively, said lever, when in said active position being abutted against the upstream side of said damper plate to displace the latter away from said outlet end toward the open position and, when in the inactive position being retracted away from the inner side of said damper plate.

5. The combination of claim 1 wherein said appliance includes an electrical control circuit which must be closed to initiate operation and to maintain operation of said appliance, said circuit including a normally open damper position control switch therein, said connecting means being operative to close said control switch responsive to full actuation of said solenoid.

6. In combination with a combustion air supply duct including an outlet end, a mount carried by one side of said outlet end, pivot means defining a pivot axis disposed outwardly of and adjacent said one side of said outlet end and swingably supported from said mount for lateral shifting outwardly away from and back toward said one side, a damper plate, said damper plate including an outwardly projecting lever arm from one end of which said damper plate is supported, a portion of said lever arm intermediate its opposite ends being supported for swinging oscillation about said axis with said lever arm disposed transverse to said axis and said damper plate being swingable with said lever arm into and out of position extending across and closing said outlet end, and a thermostat electrical circuit controllable solenoid operatively connected with the other end of said lever arm by lost motion connecting means for swinging said other end in an upstream direction relative to said outlet end responsive to actuation of said solenoid, said connecting means operatively connecting said solenoid to said other end of said lever arm by a lost motion connection therewith wherein full movement of the lever arm to the damper plate open position may lag relative to full actuation of said solenoid to open said damper plate, said connecting means including means yieldingly biasing said lever arm to a position with said damper plate in the open position responsive to full actuation of said solenoid.

7. The combination of claim 6 wherein said lever arm includes means gravity yielding said lever arm toward a position with said damper plate closing the outlet end of said duct.

8. In combination, an interior building area in which at least one heat of combustion powered appliance is disposed, a combustion air inlet for said building area including an air supply duct having an outlet end opening into said area, a valve assembly for said outlet end for closing said outlet end during periods of non-operation of said appliance and opening said outlet end during periods of operation of said appliance, said valve assembly including a mount supported adjacent one side of said outlet end and defining a pivot axis disposed transverse to a path extending generally radially outwardly from the center of said outlet end, a damper plate mounted for swinging oscillation about said axis between a closed position extending across and closing said outlet end and an open position inclined relative to and extending outwardly of said outlet end, and appliance operation controlling means operatively controllably connected to said appliance, said operation controlling means including an active operational mode to initiate and maintain operation of said appliance and a passive operational mode to terminate operation of said appliance, damper motor means operatively connected to said damper for opening and closing the latter and under the control of said operation controlling means for opening said damper when said operation controlling means is in said active operational mode and closing said damper when said operation control controlling means is in said passive operational mode.

* * * * *